US011457760B2

(12) United States Patent
Santa et al.

(10) Patent No.: US 11,457,760 B2
(45) **Date of Patent: *Oct. 4, 2022**

(54) ARTIFICIAL TREE ASSEMBLY

(71) Applicant: South Florida Lighting Team, LLC, Miami Beach, FL (US)

(72) Inventors: Edwin Santa, Miami, FL (US); Kurt Stange, Miami Beach, FL (US)

(73) Assignee: SOUTH FLORIDA LIGHTING TEAM, LLC, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/069,401

(22) Filed: Oct. 13, 2020

(65) Prior Publication Data

US 2021/0022537 A1 Jan. 28, 2021

Related U.S. Application Data

(63) Continuation of application No. 15/951,629, filed on Apr. 12, 2018, now Pat. No. 10,799,053.

(60) Provisional application No. 62/484,601, filed on Apr. 12, 2017.

(51) Int. Cl.
*A41G 1/00* (2006.01)
*A47G 33/06* (2006.01)

(52) U.S. Cl.
CPC ..... *A47G 33/06* (2013.01)

(58) Field of Classification Search
None
See application file for complete search history.

(56) References Cited

U.S. PATENT DOCUMENTS

| | | | |
|---|---|---|---|
| 1,490,409 | A | 4/1924 | Ventresca |
| 2,503,359 | A | 4/1950 | Smith |
| 2,586,791 | A | 2/1952 | Dattilo |
| 3,118,617 | A | 1/1964 | Hellrich |
| 3,219,512 | A | 11/1965 | Kovacevic |
| 3,544,783 | A | 12/1970 | Williams, Sr. |
| 3,839,131 | A | 10/1974 | Christiansen, Jr. |
| 3,959,536 | A | 5/1976 | Chase |

(Continued)

FOREIGN PATENT DOCUMENTS

| | | |
|---|---|---|
| DE | 202010014040 | 12/2010 |
| EP | 2250948 | 11/2010 |
| WO | WO2016134187 | 8/2016 |

OTHER PUBLICATIONS

Discovery Toys, Measure Up! Cups Educational Stacking & Nesting Embossed, Numbers, 12 Pieces Set to Learn Volume & Math by Discovery Toys, (based on date of posted question by D. Baker), Amazon, Apr. 1, 2015.

(Continued)

*Primary Examiner* — Seth Dumbris
*Assistant Examiner* — Kim S. Horger
(74) *Attorney, Agent, or Firm* — Malloy & Malloy, P.L.

(57) ABSTRACT

An improved artificial tree of the present invention is directed to a decorative artificial tree assembly which may be dimensioned and configured to fit on any supporting surface including, but not limited to, an interior floor, outside grounds, etc. The artificial tree may be disposed in an assembled or collapsed state. As such, the artificial tree may include a plurality tree segments and a cap member, vertically interconnected or stacked upon each other via a plurality of connectors. The artificial tree may be constructed from lightweight materials with decorative items attached to its outer surface.

15 Claims, 7 Drawing Sheets

(56) References Cited

U.S. PATENT DOCUMENTS

| | | | |
|---|---|---|---|
| 4,219,594 | A | 8/1980 | Herrera-Cabello |
| 4,878,157 | A | 10/1989 | Koch |
| 4,988,322 | A | 1/1991 | Knudsen |
| 5,128,180 | A | 7/1992 | Acton |
| 6,200,656 | B1 | 3/2001 | Sang |
| 6,270,864 | B1 | 8/2001 | Weiss |
| 7,160,588 | B2 | 1/2007 | Sanford et al. |
| 10,799,053 | B2 | 10/2020 | Santa et al. |
| 2003/0137106 | A1 | 7/2003 | Pavlovits |
| 2005/0048226 | A1 | 3/2005 | Gary et al. |
| 2005/0249892 | A1 | 11/2005 | Rocheleau |

OTHER PUBLICATIONS

Dyan Robson, Christmas Stem Activity for Kids Wth Magna-Tiles & Jingle Bells, and Next Comes L., Dec. 1, 2014.

ARTIFICIAL TREE ASSEMBLY

CLAIM OF PRIORITY

The present invention is a continuation of a previously filed application having Ser. No. 15/951,629 and a filing date of Apr. 12, 2018, which will mature into U.S. Pat. No. 10,799,053 on Oct. 13, 2020, and which is based on, and a claim of priority was made under 35 U.S.C. Section 119(e), to a provisional patent application having Ser. No. 62/484,601 and a filing date of Apr. 12, 2017. All of which are incorporated herewith in its entireties.

BACKGROUND OF THE INVENTION

Field of the Invention

The present invention is directed to an artificial tree assembly which may be dimensioned and configured to fit on any supporting surface including, but not limited to, an interior floor, outside grounds, etc. The artificial tree may be disposed in an assembled or collapsed state. As such, the artificial tree may include a plurality tree segments, vertically interconnected upon each other via a plurality of removable connectors. The artificial tree may be constructed from lightweight materials with decorative items attached to its outer surface when in the assembled or collapsed state. Thus, the completely decorated artificial tree may be safely disposed between the collapsed state and the assembled state in seconds. In addition, the plurality of tree segments may be disposed in a substantial flattened orientation when the artificial tree is returned to the collapsed state.

Description of the Related Art

Decorated artificial trees are commonly associated with the celebration of Christmas, however, they are also used during other holiday seasons and for general purpose décor. Christmas trees are ubiquitous seasonal decorations during the holiday season for many people in numerous countries of the world. Although real-cut trees maintain an attractive appearance for a limited period of time, maintenance such as frequent watering, fluffing, re-centering, spraying for insects, etc. is required. Further, real-cut trees require a replacement if the tree is to be maintained in a location during a prolonged period of time, which is often the case as retailers, communities, and individuals begin decorating for the holiday season ever earlier in the year. As such, real-cut trees are often not ideal. As a result, artificial trees have increased in popularity. However, conventional artificial trees are both heavy and difficult to store due to their size and shape. In addition, they are often expensive because their manufacture requires metal parts as well as the use of expensive materials and processes for creating realistic imitation evergreen needles. In addition, conventional artificial trees can also be difficult to transport and assemble, particularly in the case of larger artificial trees, due to the sizes of their components. As such, there appears to be a need for an artificial tree that is lightweight, easily assembled/disassembled, and sufficiently sturdy in its construction to be available for repeated use throughout several holiday seasons.

SUMMARY OF THE INVENTION

The present invention is directed to an artificial tree assembly which may be dimensioned and configured to fit on any supporting surface including, but not limited to, an interior floor, outside grounds, etc. The artificial tree may be decoratively disposed in an assembled or collapsed state. As such, the artificial tree may include a plurality of components, such as tree segments including a base member and at least one intermediate member, and a cap member, vertically interconnected or stacked upon each other via a plurality of connectors. The artificial tree may be constructed from lightweight materials such as, but not limited to, polypropylene, expanded polypropylene foam or foam rubber, etc., with decorative items attached to its outer surface. The decorative items may remain on the artificial tree while in both the assembled and collapsed states.

The plurality of components may include vertically connected components that may be stacked one upon another to assemble the artificial tree. The artificial tree may include a base member that may be configured to connect on a floor surface, one or more intermediate members that stack upon each other and the base member, and a cap member that stacks upon the uppermost intermediate member. The artificial tree may comprise a substantial conical configuration. As such, the stackable components may comprise tapered conical, or substantially frusto-conical, configurations that include a bottom portion that has a greater dimension than its top portion. For example, the bottom portion of the lowermost intermediate member may include a dimension that is substantially equal to the dimension of the top portion of the base member. Further, the bottom portion of the cap member may include a dimension that is substantially equal to the dimension of the top portion of the uppermost intermediate member.

The assembled orientation of the artificial tree may be disposable in an assembled-ready state after all the series of components are interconnected to each other. In contrast, when in the collapsed orientation, the components may be disposed in a stored, transport-ready state. In one embodiment, the components may be disposed in a nested configuration with each other. In another embodiment, at least some of the components may be disposed in a substantially flattened state and can be stored and/or shipped in extremely small locations and containers.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
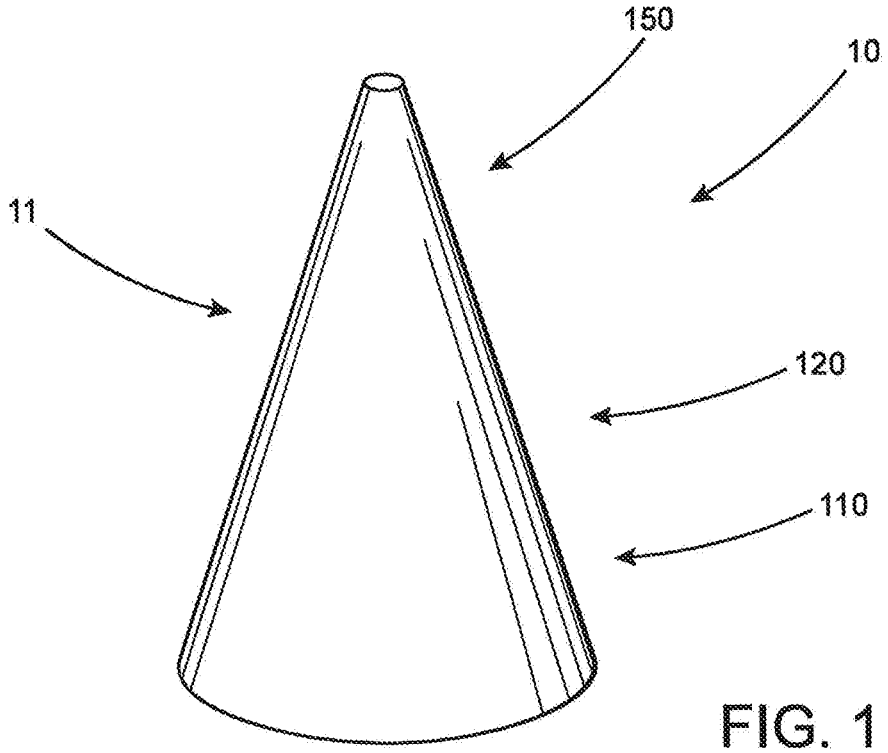
FIG. 1 is a perspective view of one preferred embodiment of an artificial tree assembly of the present invention in an assembled orientation.
Figure 2:
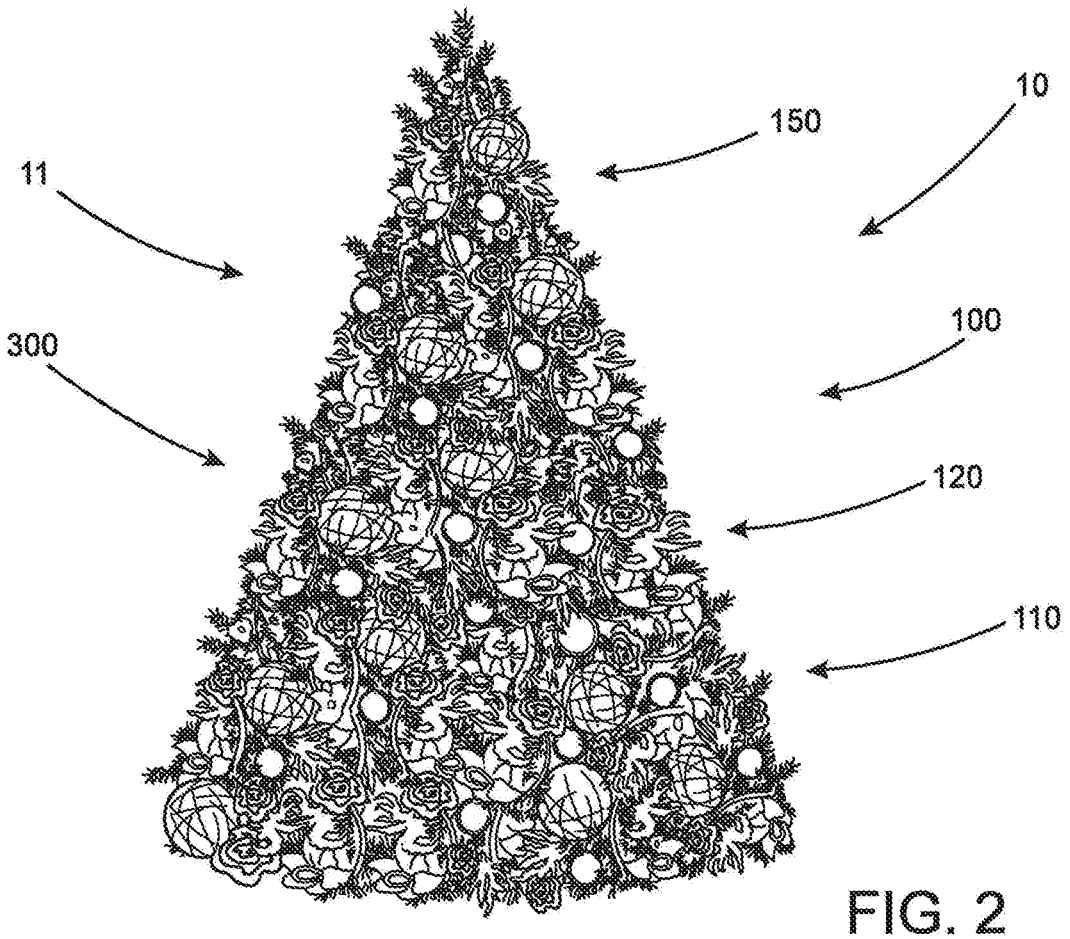
FIG. 2 is a perspective view of another preferred embodiment of an artificial tree assembly of the present invention in an assembled orientation.

As represented in the accompanying Figures and with initial, reference to FIG. 1, the present invention is directed to an artificial tree assembly generally indicated as 10 which may be dimensioned and configured to fit on any supporting surface. For purposes of clarity and without limiting the scope of the present invention, the structural features of this invention will be described with reference to the artificial tree 10 being in the form of a conically shaped Christmas tree, as represented in FIGS. 1-2. However, it is emphasized that the artificial tree 10 of the present invention can be in the form of any tree, shrub, bush, etc., in addition to and other than conically shaped Christmas trees or the like. For example, in one embodiment the artificial tree 10 may comprise a substantially columnar configuration, at least when the artificial tree 10 is in an assembled orientation 11. In another embodiment, the artificial tree 10 may comprise a substantially tapered configuration, at least when the artificial tree 10 is in the assembled orientation 11. For purposes of clarity, the structural features of this invention will be described with reference to the artificial tree 10 comprising a substantial tapered (defined herein as a gradual vertical narrowing or reduction of the dimension of the artificial tree from the base to the cap or uppermost end (e.g., conically shaped Christmas tree)) configuration.

Figure 3:
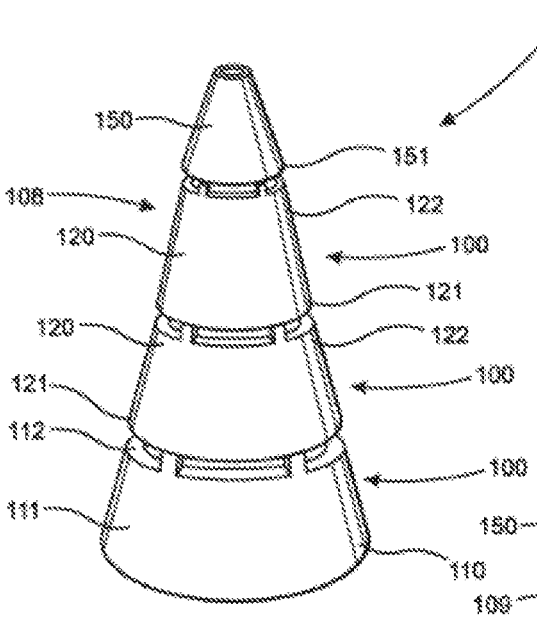
FIG. 3 is a perspective view of the embodiment in FIG. 1 in exploded form.
Figure 4:
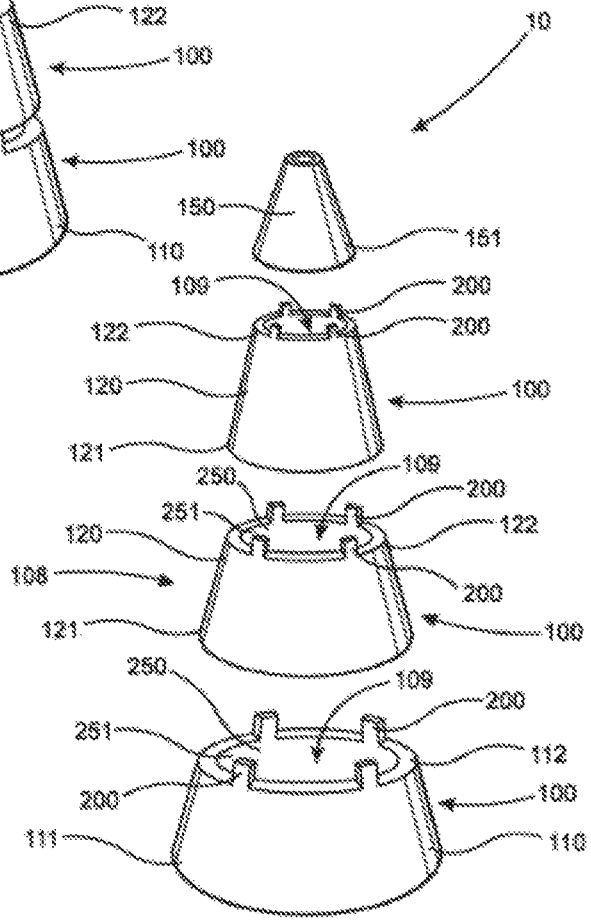
FIG. 4 is yet another perspective view of the embodiment in FIG. 1 in exploded form.
Figure 5:
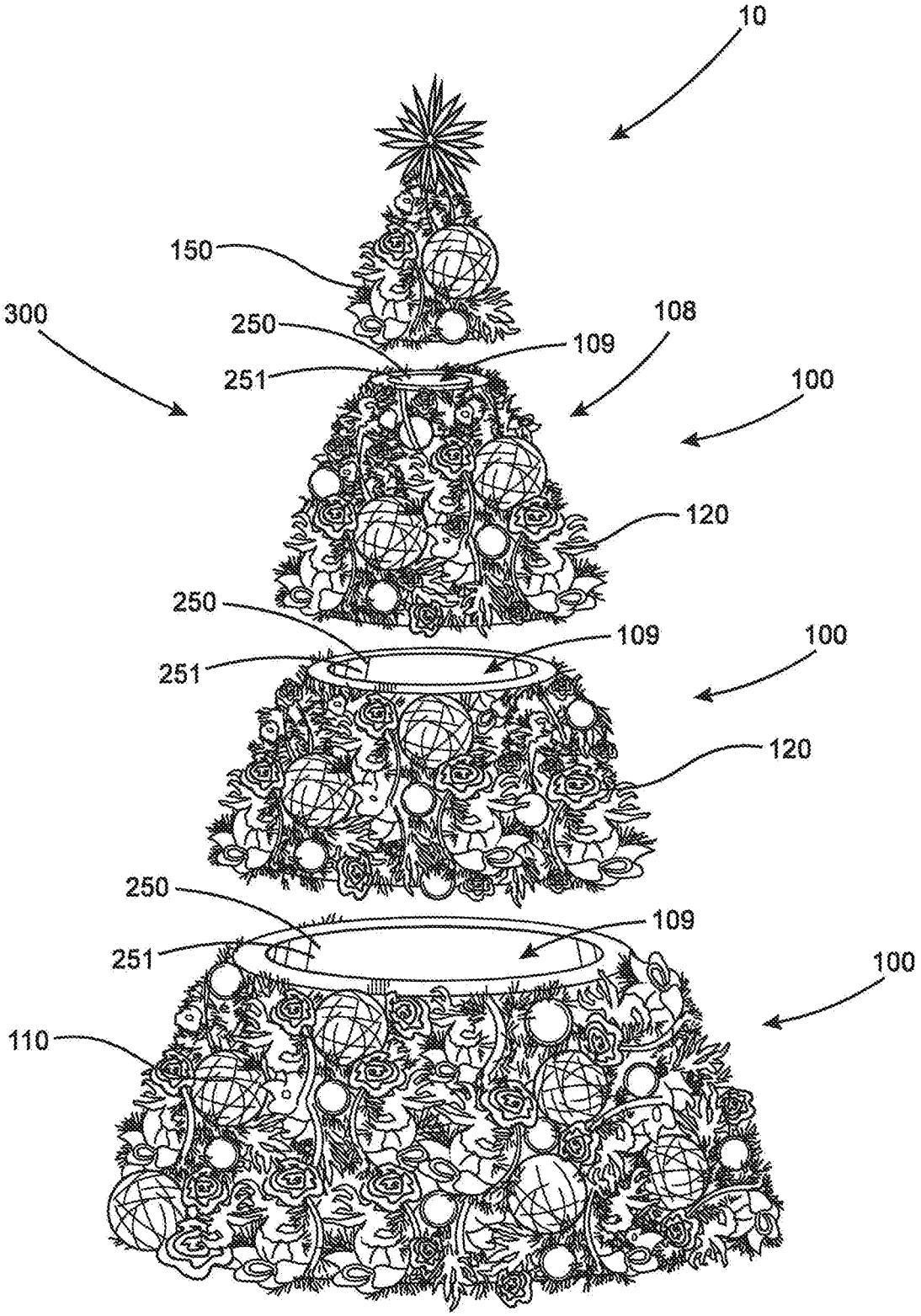
FIG. 5 is a perspective view of the embodiment in FIG. 2 in exploded form.

The artificial tree 10 may be structured for selective positioning between an assembled orientation 11 and a collapsed orientation 12, as described in greater detail below and generally represented in FIGS. 1-2 and 10-11 respectively. As represented in FIGS. 3-5, the artificial tree 10 may comprise a plurality of tree segments 100 disposed in vertical adjacent relation to one another and a cap member 150 disposed in vertical adjacent relation to the plurality of tree segments 100, at least when the artificial tree 10 is in the assembled orientation 11. The plurality of tree segments 100 may include a base member 110 disposed on and extending outwardly from a supporting surface and at least one intermediate member 120 removably connected to the base member 110 via a plurality of connecting members 200. As such, and in order to provide a conically shaped artificial tree 10, the dimension of the bottom portion 121 of the intermediate member 120 may substantially equal the dimension of the top portion 112 of the base member 110 and securely connect thereto via the plurality of connecting connecting members 200 in at least FIGS. 6-8, extending laterally and vertically outward therefrom. The cap member 150 may be removably connected to the at least one intermediate member 120 and extend vertically outward therefrom via the plurality of connecting members 200.

This removable connection via the connecting members 200 may be accomplished by sufficiently strong connecting structures to maintain a sturdy connection such that the artificial tree 10 does not unintentionally disassemble, lean, etc., while in the assembled orientation 11. Accordingly, such connecting structures may include structured connectors such as magnets which allow a secure but removable positioning of the plurality of tree segments 100 and cap member 150 while interconnected to each other in the assembled orientation 11, but also allows for their removal when so chosen by the end user.

As illustrated in FIGS. 1-5, the artificial tree 10 may comprise a substantial conical configuration including a stacked series of tapered components, at least when in the assembled orientation 11. As such, the base member 110, the at least one intermediate member 120, and the cap member 150 may each comprise a substantial tapered configuration, each including a bottom portion having a greater dimension than its top portion. For example, the bottom portion 111 of the base member 110 may be disposed on a supporting surface, such as a floor or the ground, and define the greatest dimension of all the stacked series of components. Further, the at least one intermediate member 120 may vertically connect or "stack" upon the greater-dimensioned base member 110. As such, and in order to provide a conically shaped artificial tree 10, the dimension of the bottom portion 121 of the intermediate member 120 may substantially equal the dimension of the top portion 112 of the base member 110 and securely connect thereto via the plurality of connecting members 200. In addition, if the end user would like to increase the height of the artificial tree 10, he/she can include more than one intermediate member 120, stacked upon one another. It being noted and understood that the additional one or more intermediate members 120 would be correspondingly and cooperatively dimensioned to the adjacent members to which they are connected. Thus, in the preferred embodiment, the dimension and configuration of the additional intermediate member(s) 120 are properly dimensioned in order to maintain the conical configuration of the artificial tree 10.

In contrast, if the end user would like to decrease the height of the artificial tree 10, he/she can remove at least one intermediate member 120 (additionally, if the end user removes the base member 110, then the lowermost intermediate member 120 will become the base member 110). Lastly, the cap member 150 may vertically connect or stack upon the (uppermost) greater-dimensioned intermediate member 120. As such, the dimension of the bottom portion 151 of the cap member 150 may substantially equal the dimension of the top portion 121 of the (uppermost) intermediate member 120, securely connected thereto via the plurality of connecting members 200.

As illustrated in FIGS. 3-5, in a preferred embodiment, the plurality of tree segments 100 and at least the bottom portion 151 of the cap member 150 may comprise a substantial annular configuration having an apertured construction 250 comprising at least one aperture 251. More specifically, the plurality of tree segments 100 may include an outer portion 108 defining the outer circumference of the tree segment 100 and an inner portion 109 defining the inner circumference of the tree segment 100 and forming a substantially hollow center. The inner portions 109 of the plurality of tree segments 100 and the cap member 150 may be cooperatively dimensioned and configured to form a substantial columnar central cavity, when the artificial tree 10 is in the assembled orientation 11. This unique structure and configuration will facilitate ease of assembly and disassembly as well as stability of the artificial tree 10 when in the assembled orientation 11. The inner and outer portions 109 and 108 preferably extend along the interior and exterior circumferences respectively of the plurality of tree segments 100 and at least a portion of the cap member 150. However, the exterior configuration of the outer portions 108 may vary significantly by virtue of the added decorative member 300, as depicted in FIGS. 2 and 5. Such a decorative member 300 may include decorative components such as, but not limited to, added adornments including outer surface bulbs, lights, flowers, etc.

As such, and as illustrated in FIGS. 3-5, the bottom portion of each of the conically shaped plurality of tree segments 100 and cap member 150 may have a greater diameter than its top portion. For example, the bottom portion 111 of the base member 110 may be disposed on a supporting surface, such as a floor or the ground, and define the greatest diameter of all the stacked series of components. Further, the at least one intermediate member 120 may vertically connect or "stack" upon the base member 110, which has a greater diameter. As such, the diameter of the bottom portion 121 of the intermediate member 120 may substantially equal the diameter of the top portion 112 of the base member 110, secured and connected thereto via the plurality of connecting members 200. Lastly, the cap member 150 may vertically connect or stack upon the (uppermost) intermediate member 120, which has a greater diameter. As such, the diameter of the bottom portion 151 of the cap member 150 may substantially equal the diameter of the top portion 122 of the (uppermost) intermediate member 120, securely connected thereto via the plurality of connecting members 200.

Further, as mentioned above, the artificial tree 10 may include a decorative member 300 disposed on the outer portions 108 of the plurality of tree segments 100 and cap member 150, as depicted in FIG. 5. The decorative member 300 may include flowers, lights, garland, etc., and may be structured to remain on the outer portion 108 of the plurality of tree segments 100 and cap member 150 whether the artificial tree 10 is in the assembled orientation 11 or the collapsed orientation 12. More specifically, the decorative member 300 may be disposed in interconnecting relation when the artificial tree 10 is in the stored, transport-ready state. This will save a considerable amount of time for the end user to dispose the artificial tree 10 in the assembled orientation 11. Moreover, the plurality of tree segments 100 and cap member 150 may be formed of a lightweight material such as a flexible foam material to aid in assembly of the artificial tree 10 and connection (or disconnection) of the decorative member 300 thereto. Furthermore, the artificial tree 10 may be comprised of such a material as to facilitate simple stacking or assembling by an end user of the present invention, thus disposing the artificial tree 10 easily between the assembled orientation 11 and the collapsed orientation 12, as depicted in FIGS. 1 and 8*a*-8*b* respectively.

Figure 9A:
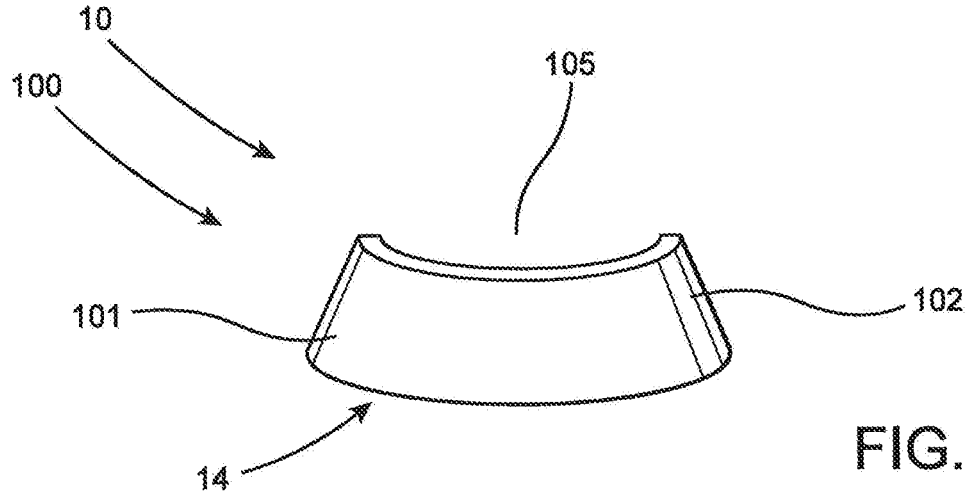
FIG. 9A is a perspective view in partial cutaway of a preferred embodiment of a tree segment in a non-operative orientation.
Figure 9B:
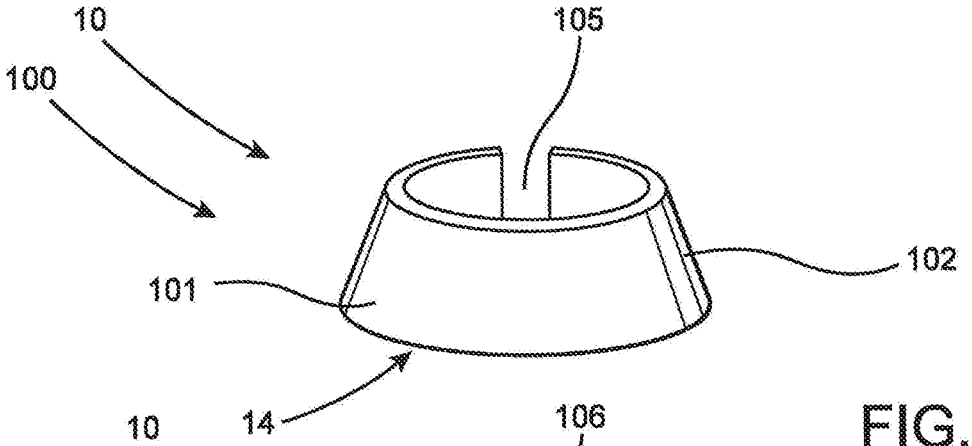
FIG. 9B is another perspective view in partial cutaway of a preferred embodiment of a tree segment in a non-operative orientation.
Figure 9C:
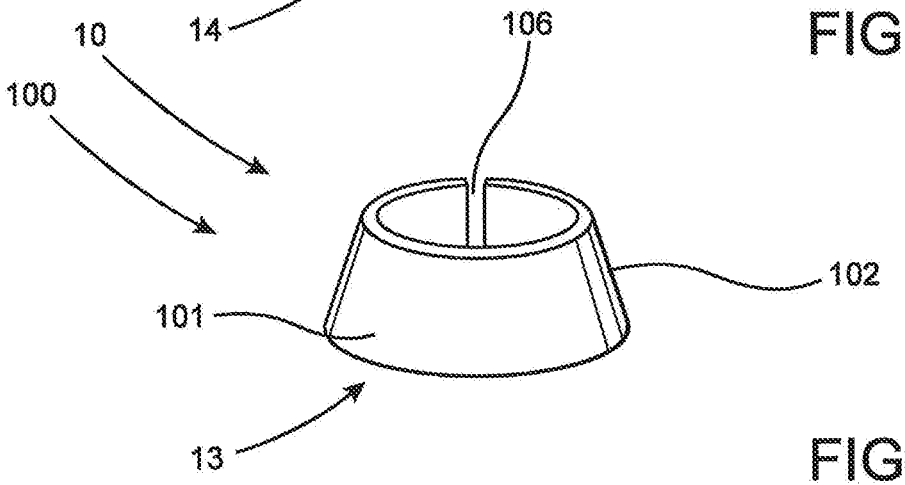
FIG. 9C is a perspective view in partial cutaway of a preferred embodiment of a tree segment in an operative orientation.

As illustrated in FIGS. 9A-9C, in a preferred embodiment, the plurality of tree segments 100 may be disposed between a contracted orientation (annular shaped) and an expanded orientation (substantially flat shaped). More specifically, the plurality of tree segments 100 may be structured for selective positioning between an operative orientation 13 and a non-operative orientation 14. Moreover, each of the plurality of tree segments 100 may comprise a proximal end 101 and a distal end 102 disposed in removably interconnecting relation to each other, at least when the tree segment 100 is in the operative orientation 13.

As such, the plurality of tree segments 100 are disposed in vertically connecting relation to one another via the plurality of connecting members 200, at least when each of the tree segments 100 are in the operative orientation 13. Additionally, the cap member 150 is disposed in vertically connecting relation to the plurality of tree segments 100, via the connecting members 200, and extending outwardly therefrom, at least when the plurality of tree segments 100 are in the operative orientation 13 and the artificial tree 10 is in the assembled orientation 11. As such, the assembled orientation 11 of the artificial tree 10 is defined by the plurality of tree segments 100 in the operative orientation 13 and the cap member 150 connected thereto, as depicted in FIGS. 1-2.

Figure 10:
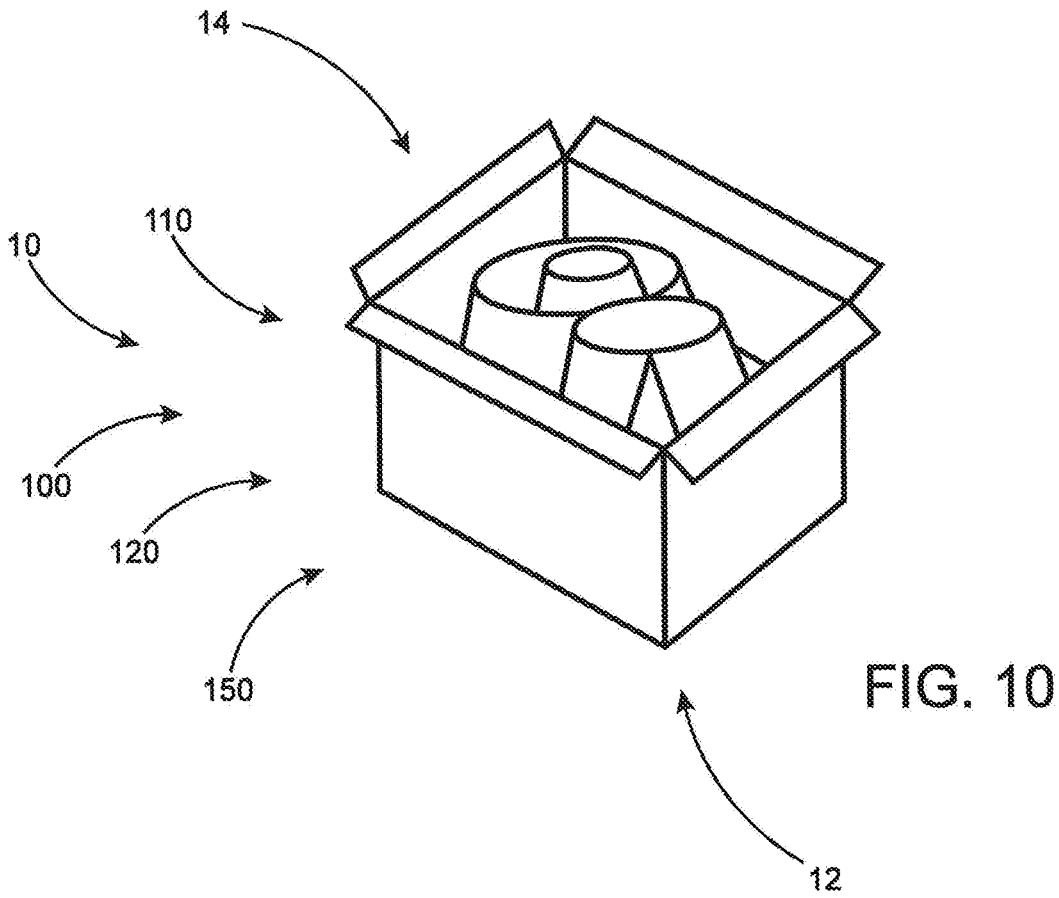
FIG. 10 is a perspective view in partial cutaway of a preferred embodiment of the artificial tree in a collapsed orientation.
Figure 11:
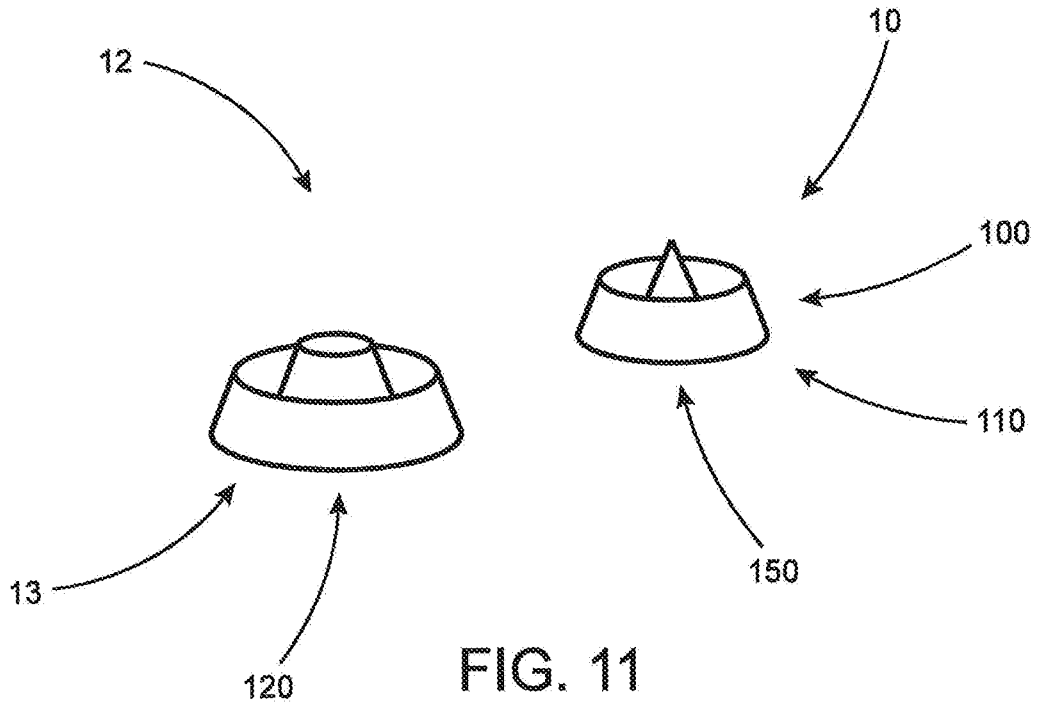
FIG. 11 is another perspective view in partial cutaway of a preferred embodiment of the artificial tree in a collapsed orientation.

As such, when the artificial tree 10 is in the assembled orientation 11, the inner surfaces of the interconnected plurality of tree segments 100 and cap member 150 are not exposed and not clearly viewable, as illustrated in FIGS. 1-2. In contrast, if any of the plurality of tree segments are in the non-operative orientation 14 or the cap member 150 is not in connecting relation with the plurality of tree segments 100, the artificial tree 10 is in the collapsed orientation 12 and the inner surfaces 109 of at least one of the plurality of tree segments 100 or cap member 150 is exposed, accessible and clearly viewable, as illustrated in FIGS. 10-11.

More specifically, when the cap member 150 is disposed in connecting relation to the plurality of tree segments 100, the plurality of tree segments 100 will be disposed in the operative orientation 13 and the inner surfaces will not be viewable, as represented in FIGS. 1-2. However, when the cap member 150 is not disposed in connecting relation to the plurality of tree segments 100, the inner surfaces may be exposed and therefore be clearly viewable and accessible to the user. Therefore, the artificial tree 10 will be in the aforementioned collapsed orientation 12, as represented in FIGS. 10-11.

As illustrated in FIGS. 9A-9C, the non-operative orientation 14 of a tree segment 100 may comprise the proximal and distal ends 101 and 102 disposed in a spaced relation to each other, defining an opening therebetween 105. The operative orientation 13 of the tree segment 100 may comprise a minimum lateral spacing 106 or alternatively no spacing at all between the proximal and distal ends 101, 102 of the tree segment 100. The non-operative orientation 14 of the tree segments 100 may comprise a further lateral spacing and less adjacent disposition of the proximal and distal ends 101 and 102 than the minimum lateral spacing 106 of the proximal and distal ends 101 and 102 when the tree segment 100 is in the operative orientation 13.

Figure 6:
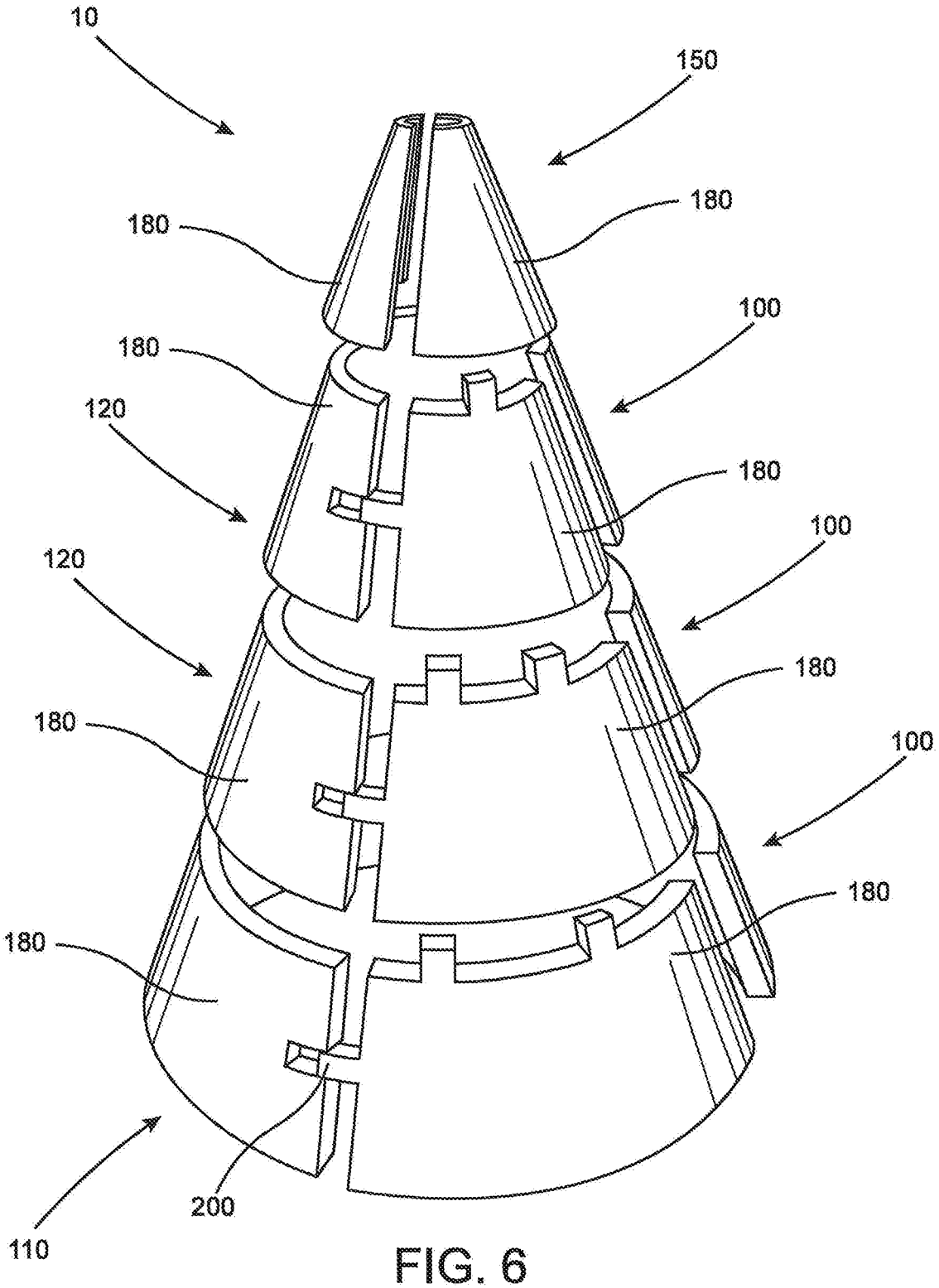
FIG. 6 is a perspective view of yet another preferred embodiment of an artificial tree assembly of the present invention in exploded form.
Figure 7:
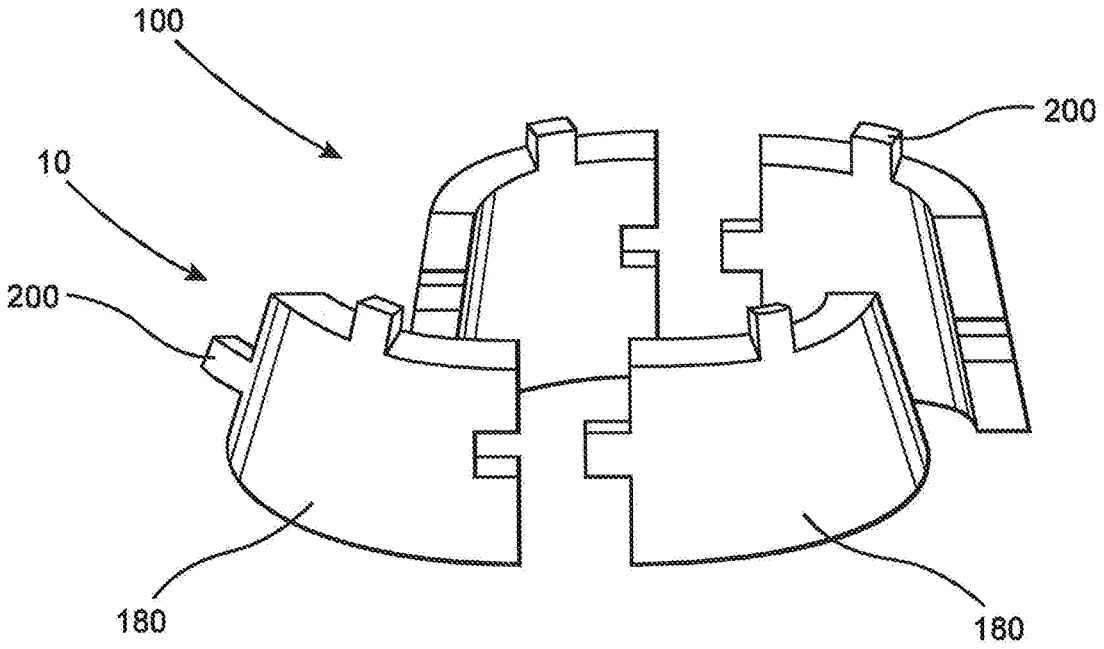
FIG. 7 is a perspective view in partial cutaway of a tree segment of the artificial tree of the embodiment in FIG. 6 in exploded form.
Figure 8:
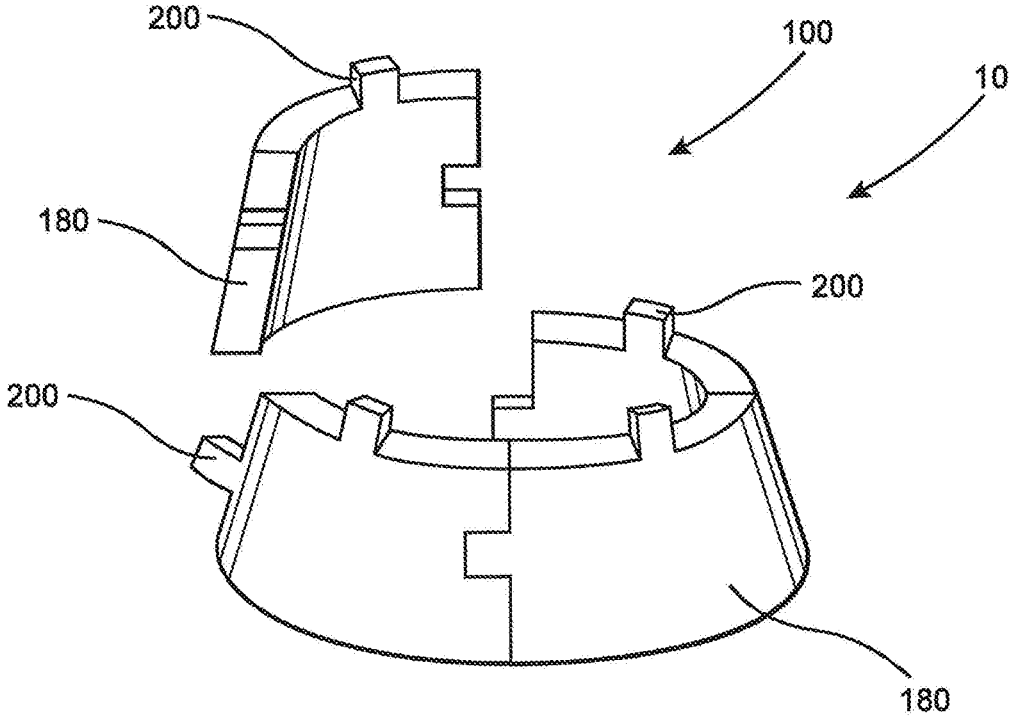
FIG. 8 is yet another perspective view in partial cutaway of a tree segment of the artificial tree of the embodiment in FIG. 6 in exploded form.

As illustrated in FIGS. 6-8, in another embodiment, at least some of the plurality of tree segments 100 may comprise a plurality of branch segments 180 disposed in removably interconnected relation to each other via connecting members 200. This will allow the end user to create a larger artificial tree 10. As such, at least some of the plurality of tree segments 100 are disposable in a plurality of different heights, each height determined by an amount of the branch segments 180; at least some of the plurality of tree segments 100 are disposable in a plurality of different lengths, each length determined by an amount of the branch segments 180. As such, the end user can increase both the height and the length of the artificial tree 10.

In a preferred embodiment, at least some of the plurality of annular shaped tree segments 100 are disposable in a plurality of different circumferences, each circumference determined by an amount of the branch segments 180. Moreover, at least a portion of the plurality of tree segments 100 include a curved configuration along its respective length. In addition, each curved configuration of the tree segment 100 may be more specifically defined by a plurality of curved branch segments 180. Accordingly, a plurality of curved branch segments 180 of a curved configuration of the same tree segment 100 may be disposed in immediately adjacent, successive and/or contiguous relation to one another as the curved branch segments 180 collectively extend along the length of the tree segment 100. Moreover, at least some of the curved branch segments 180 of a tree segment 100, may be defined by a substantially convex configuration. As such, the end user can increase the circumference (which may include an increase in height and/or length) of the artificial tree 10.

The removable connection by the connecting members 200 may be accomplished by sufficiently strong connecting structures to maintain a sturdy connection such that the branch segments 180 do not unintentionally disassemble. Accordingly, such connecting structures may include structured connectors such as magnets or arcuate tabs/grooves which allow a secure but removable positioning of the plurality of branch segments 180 while interconnected to each other, but also allows for their removal when so chosen by the end user. For example, the connecting member 200 may include arcuate tabs protruding out from both horizontal and vertical peripheral edges of one or all of the tree segments 100 and grooves, slots, etc. in which the arcuate tabs are received, wherein the grooves, slots, etc. are also cooperatively disposed in peripheral edge portions of the branch segment 180 to be connected.

As discussed above, the artificial tree 10 may be structured for selective positioning between an assembled orientation 11 and a collapsed orientation 12. In addition, the assembled 11 and collapsed orientations 12 may be respectively disposable between an assembled-ready state and a stored, transport-ready state. For example, as illustrated in FIGS. 10-11, at least some of the plurality of tree segments 100 may be disposed in a nested relation to each other, and the cap member 150 may be disposed in a nested relation to at least one of the plurality of tree segments 100, at least when the artificial tree 10 is in the collapsed orientation 12. As such, the artificial tree 10 may comprise a plurality of annular shaped tree segments 100 in order to facilitate efficient packing and storage of the present invention. In another embodiment, the artificial tree 10 may include appropriate structuring to allow the plurality of tree segments 100 to be disposed in a substantially flattened, stored state (not shown for clarity). As such, the various tree segments 100 may be stored and/or shipped in a relatively flat configuration.

The general shape of the plurality of tree segments 100 is such that it is capable of being stored and/or transported in a substantially flat configuration and then re-assembled by an end user relatively easily. As such, the plurality of tree segments 100 may be disposed in a flattened or transport-ready state, in that it is configured to be stored or packaged efficiently. Thusly disposed, the plurality of tree segments 100 and cap member 150 of the artificial tree 10 may be stored or transported in an extremely space efficient configuration. As such, the end user may store the artificial tree in small areas, such as under a bed.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A tree assembly comprising:

an artificial tree structured for selective positioning between an assembled orientation and a collapsed orientation;

said assembled orientation comprising a plurality of tree segments disposed in vertically connecting relation to one another;

each of said tree segments comprising a plurality of branch segments;

said plurality of tree segments disposed in vertically connecting relation to one another and said branch segments disposed in horizontally adjacent connecting relation to one another, via a plurality of connecting members;

at least some of said plurality of connecting members comprising at least one of a tab protruding outwardly and a groove encompassed inwardly from a peripheral edge of said tree segments;

said assembled orientation further comprising said plurality of tree segments comprising a cap member disposed in adjacent relation to said plurality of tree segments;

said collapsed orientation comprising said plurality of tree segments disposed in a substantially flattened state;

said assembled and collapsed orientations respectively disposable between an assembled-ready state and a stored, transport-ready state; and said transport-ready state comprising at least one adjacent pair of said branch segments separated from one another resulting in said tree segments disposed in a substantially flattened state and in a flat stacked relation to each other.

2. A tree assembly as recited in claim 1 wherein said artificial tree comprises a substantially columnar configuration, at least when said artificial tree is in said assembled orientation.

3. A tree assembly as recited in claim 1 wherein said artificial tree comprises a substantially tapered configuration, at least when said artificial tree is in said assembled orientation.

4. A tree assembly as recited in claim 1 wherein at least when said artificial tree is in said assembled orientation comprising each of said plurality of tree segments having a substantially annular configuration.

5. A tree assembly as recited in claim 1 wherein said substantially flat stacked relation comprises a nested orientation between said branch segments of one of said tree segment with said branch segments of another of said tree segments.

6. A tree assembly as recited in claim 5 wherein said branch segments are curved so as to facilitate said nested orientation.

7. A tree assembly comprising:

an artificial tree structured for selective positioning between an assembled orientation and a collapsed orientation;

said artificial tree comprising a plurality of tree segments structured for selective positioning between an operative orientation and a non-operative orientation;

said operative orientation at least comprising said tree segments vertically stacking together in order to provide a conically shaped artificial tree;

each of said plurality of tree segments comprising a proximal end and a distal end; said proximal and distal ends disposed in removable interconnecting relation to each other;

a plurality of connecting members interconnecting said plurality of tree segments in a vertically, conjoined adjacent relation to one another, at least when said tree segments are in said operative orientation;

said plurality of tree segments comprising a cap member disposed in vertically adjacent relation to said plurality of tree segments via said connecting members and extending outwardly therefrom, at least when said artificial tree is in said assembled orientation;

said assembled orientation comprising said cap member vertically stacked upon said tree segments so as to provide a conically shaped artificial tree;

said assembled orientation further comprising a first tree segment acting as a base disposed above a supporting surface wherein said first tree segment is disposed in adjacent, connecting relation to said plurality of tree segments so as to provide a conically shaped artificial tree;

said collapsed orientation and said operative orientation each comprising said tree segments and said cap disposed in a nested relation to each other, and said assembled and collapsed orientations are respectively disposable between an assembled-ready state and a transport-ready state.

8. A tree assembly as recited in claim 7 wherein said plurality of tree segments comprise a substantially annular configuration when assembled; said cap member comprises a substantially conical configuration, at least when said tree segments are in said operative orientation.

9. A tree assembly as recited in claim 8 wherein said plurality of tree segments and said cap member comprise an outer portion and an inner portion.

10. A tree assembly as recited in claim 9 further comprising at least one decorative member disposed on said outer portion of at least one of said tree segments and said cap member.

11. A tree assembly as recited in claim 8 wherein at least some of said plurality of tree segments comprise a plurality of branch segments disposed in interconnected relation to each other.

12. A tree assembly as recited in claim 11 wherein at least some of said plurality of tree segments are disposable in a plurality of different heights, each height determined by a size of said branch segments.

13. A tree assembly as recited in claim 10 wherein at least some of said plurality of tree segments are disposable in a plurality of different lengths, each length determined by an amount of said branch segments.

14. A tree assembly as recited in claim 10 wherein at least some of said plurality of tree segments are disposable in a plurality of different circumferences, each circumference determined by an amount of said branch segments.

15. A tree assembly comprising:

an artificial tree structured for selective positioning between an assembled orientation and a collapsed orientation; said artificial tree comprising a substantial tapered configuration at least when in said assembled orientation;

said artificial tree comprising a plurality of tree segments structured for selective positioning between an operative orientation and a non-operative orientation;

said operative orientation comprising said plurality of tree segments disposed in a substantially tapered configuration and disposed in vertically connected relation to one another via a plurality of connecting members;

said plurality of tree segments comprising a cap member comprising a substantially conical configuration;

said cap member disposed in vertically connected relation to said plurality of tree segments via said connecting members and extending outwardly therefrom, at least when said tree segments are in said operative orientation and at least when said artificial tree is in said assembled orientation;

each of said plurality of connecting members comprising at least one of an arcuate tab protruding outwardly and a groove encompassed inwardly from a peripheral edge of said tree segments and further including a magnetic element;

said operative orientation further comprising a first tree segment acting as a base disposed above a supporting surface in adjacent, connecting relation to said plurality of tree segments so as to allow said plurality of tree segments to vertically stack upon said first tree segment;

each of said plurality of tree segments comprising a proximal end and a distal end;

said proximal and distal ends disposed in interconnecting relation to each other, at least when said tree segment is in said operative orientation, said proximal end and said distal end secured to one another;

said non-operative orientation comprising said proximal and distal ends disposed in spaced relation to each other, defining an opening therebetween;

said operative orientation comprising a substantially annular configuration;

said non-operative orientation further comprising said plurality of tree segments disposed in a substantially flattened state;

said assembled and collapsed orientations are respectively disposable between an assembled-ready state and a transport-ready state, and at least one decorative member maintaining an attached relation to said tree segments in both said artificial tree's assembled orientation and collapsed orientation.

* * * * *